US009254577B2

(12) United States Patent
Kommer

(10) Patent No.: US 9,254,577 B2
(45) Date of Patent: Feb. 9, 2016

(54) KNIFE AND SHEATH ASSEMBLY WITH REALEASABLE KNIFE SECURING FUNCTION

(71) Applicants: Russell Wilfred Kommer, N. Fargo, ND (US); Thomas Crawford, Gig Harbor, WA (US); Race Wu, Taichung (TW)

(72) Inventor: Russell Wilfred Kommer, N. Fargo, ND (US)

(73) Assignees: Thomas Crawford, Gig Harbor, WA (US); Russell Wilfred Kommer, Fargo, ND (US); Race Wu, Taichung (TW)

( * ) Notice: Subject to any disclaimer, the term of this patent is extended or adjusted under 35 U.S.C. 154(b) by 180 days.

(21) Appl. No.: 14/149,697

(22) Filed: Jan. 7, 2014

(65) Prior Publication Data

US 2015/0190938 A1 Jul. 9, 2015

(51) Int. Cl.
*B26B 29/02* (2006.01)

(52) U.S. Cl.
CPC ..... *B26B 29/025* (2013.01)

(58) Field of Classification Search
CPC ..... B26B 29/025
See application file for complete search history.

(56) References Cited

U.S. PATENT DOCUMENTS 4,805,818 A * 2/1989 Harrison ..... B26B 29/025 224/232
5,123,167 A * 6/1992 Kelley ..... B26B 29/025 224/232
5,255,436 A * 10/1993 Yoshida ..... B26B 29/025 224/232
5,315,761 A * 5/1994 Norton ..... B26B 29/025 224/232
5,379,520 A * 1/1995 Collins ..... B26B 29/025 224/232
5,915,793 A * 6/1999 Serpa ..... B26B 29/025 224/232
5,926,959 A * 7/1999 Collins ..... B26B 29/025 224/232
6,138,363 A * 10/2000 Kawashima ..... B26B 29/025 224/232
6,293,020 B1 * 9/2001 Julien ..... B21K 11/02 30/346.53
6,457,240 B1 * 10/2002 Liu ..... B26B 29/025 224/232
8,069,570 B2 * 12/2011 Taylor ..... B25F 1/00 224/232
2007/0266569 A1 * 11/2007 Nenadic ..... B26B 3/06 30/151
2015/0190938 A1 * 7/2015 Kommer ..... B26B 29/025 30/151

FOREIGN PATENT DOCUMENTS

WO WO 2010/047836 A1 * 4/2010

* cited by examiner

*Primary Examiner* — Hwei C Payer
(74) *Attorney, Agent, or Firm* — Muncy, Geissler, Olds & Lowe, P.C.

(57) ABSTRACT

A knife and sheath assembly includes a sheath including a knife receptacle defining knife-receiving open chamber, a knife stopper located at the knife receptacle and a stretchable part operable to move said knife stopper, a knife including a blade insertable into the knife-receiving open chamber, a handle and a shoulder connected between the blade and the handle and stoppable by the knife stopper to keep the blade in the knife-receiving open chamber, and an operating member including a mounting part affixed to the sheath or the knife and an actuating part connected to the mounting part and operable to force the stretchable part of the sheath against the knife stopper in direction away from the shoulder of the knife.

10 Claims, 7 Drawing Sheets

KNIFE AND SHEATH ASSEMBLY WITH REALEASABLE KNIFE SECURING FUNCTION

BACKGROUND OF THE INVENTION

1. Field of the Invention

The present invention relates to knife technology and more particularly, to a lockable knife and sheath assembly with releasable knife securing function.

2. Description of the Related Art

Commercial knife and sheath assemblies are commonly not satisfactory in function. The sheaths of conventional knife and sheath assemblies may have no stopper means to keep the inserted knife firmly in place. Some other knife and sheath assemblies have means keep the knife firmly in the sheath, however these designs do not allow removal of the knife out of the sheath conveniently. Therefore, there is considerable room for improvement.

SUMMARY OF THE INVENTION

The present invention has been accomplished under the circumstances in view. It is the main object of the present invention to provide a knife and sheath assembly with releasable knife securing function, which normally keeps the knife in place and prohibits the knife from falling out of the sheath and, is equipped with an operating member that is operable to release the knife from the sheath for allowing removal of the knife out of the sheath conveniently.

To achieve this and other objects of the present invention, a knife and sheath assembly in one embodiment of the invention includes a sheath including a knife receptacle defining knife-receiving open chamber, a knife stopper located at the knife receptacle and a stretchable part operable to move said knife stopper, a knife including a blade insertable into the knife-receiving open chamber, a handle and a shoulder connected between the blade and the handle and stoppable by the knife stopper to keep the blade in the knife-receiving open chamber, and an operating member including a mounting part affixed to the sheath and an actuating part connected to the mounting part and operable to force the stretchable part of the sheath against the knife stopper in direction away from the shoulder of the knife.

In an alternate form of the present invention, the mounting part of the operating member is affixed to the knife.

Thus When the operating part is not pressed, the knife stopper of the sheath is stopped against the shoulder of the knife, prohibiting the knife from being pulled out of the sheath. On the contrary, when the user presses the operating part of the operating member with the thumb to force the actuating part against the stretchable part of the sheath, the sheath collar is elastically expanded, and the knife stopper of the sheath is released from the shoulder for allowing the knife to be taken out of the sheath.

Other advantages and features of the present invention will be fully understood by reference to the following specification in conjunction with the accompanying drawings, in which like reference signs denote like components of structure.

DETAILED DESCRIPTION OF THE INVENTION

Figure 1:
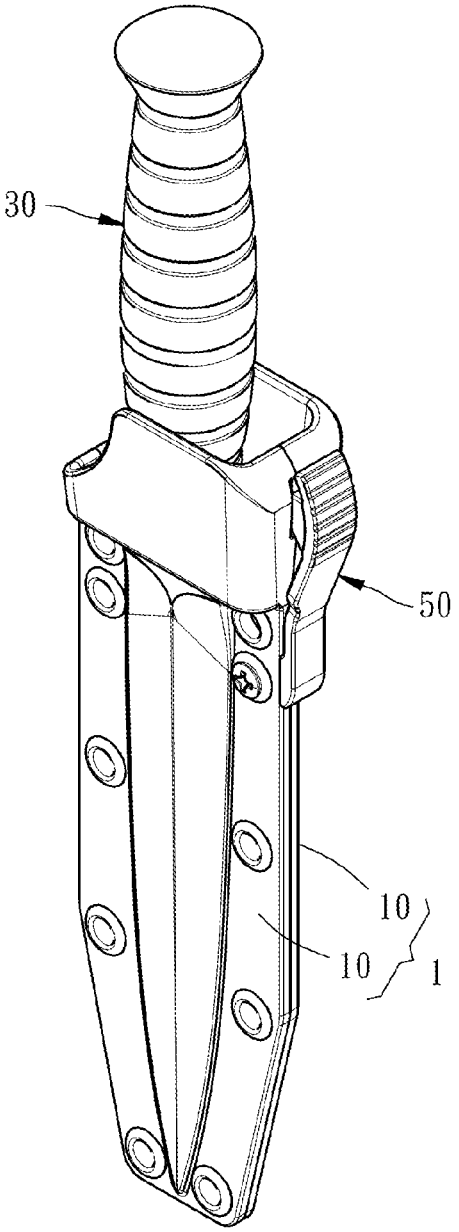
FIG. 1 is an oblique top elevational assembly view of a knife and sheath assembly in accordance with the present invention.
Figure 2:
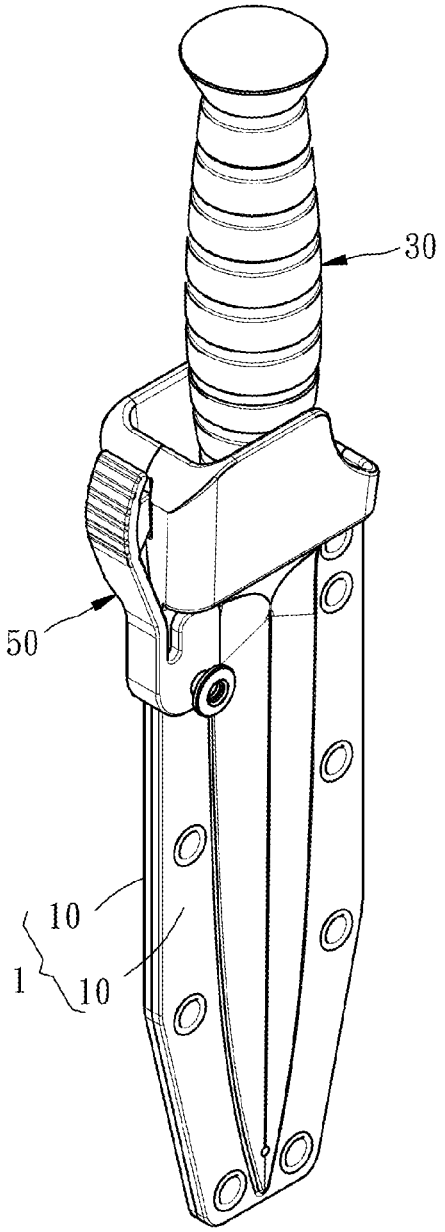
FIG. 2 corresponds to FIG. 1 when viewed from another angle.
Figure 3:
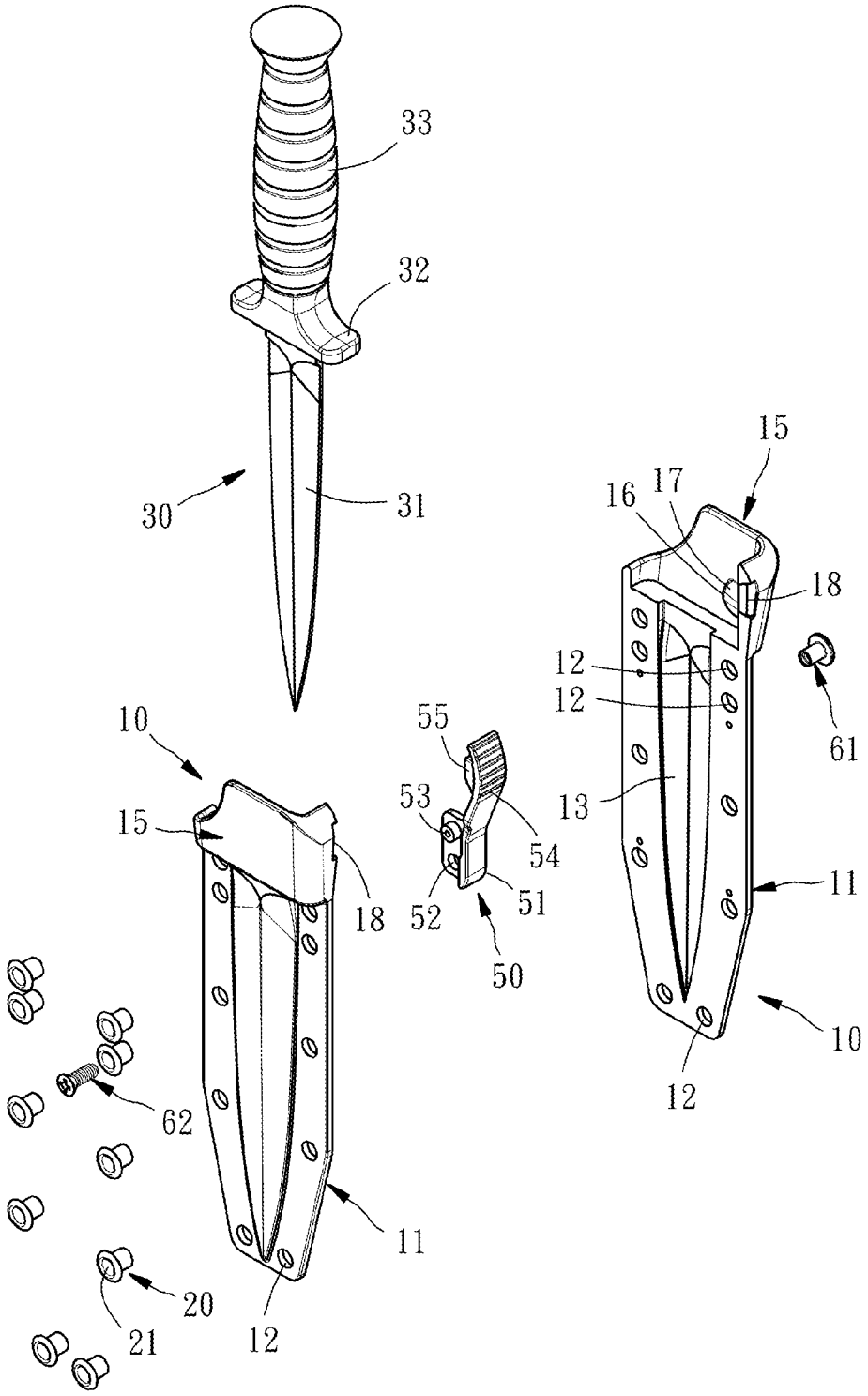
FIG. 3 is an exploded view of the knife and sheath assembly in accordance with the present invention.
Figure 4:
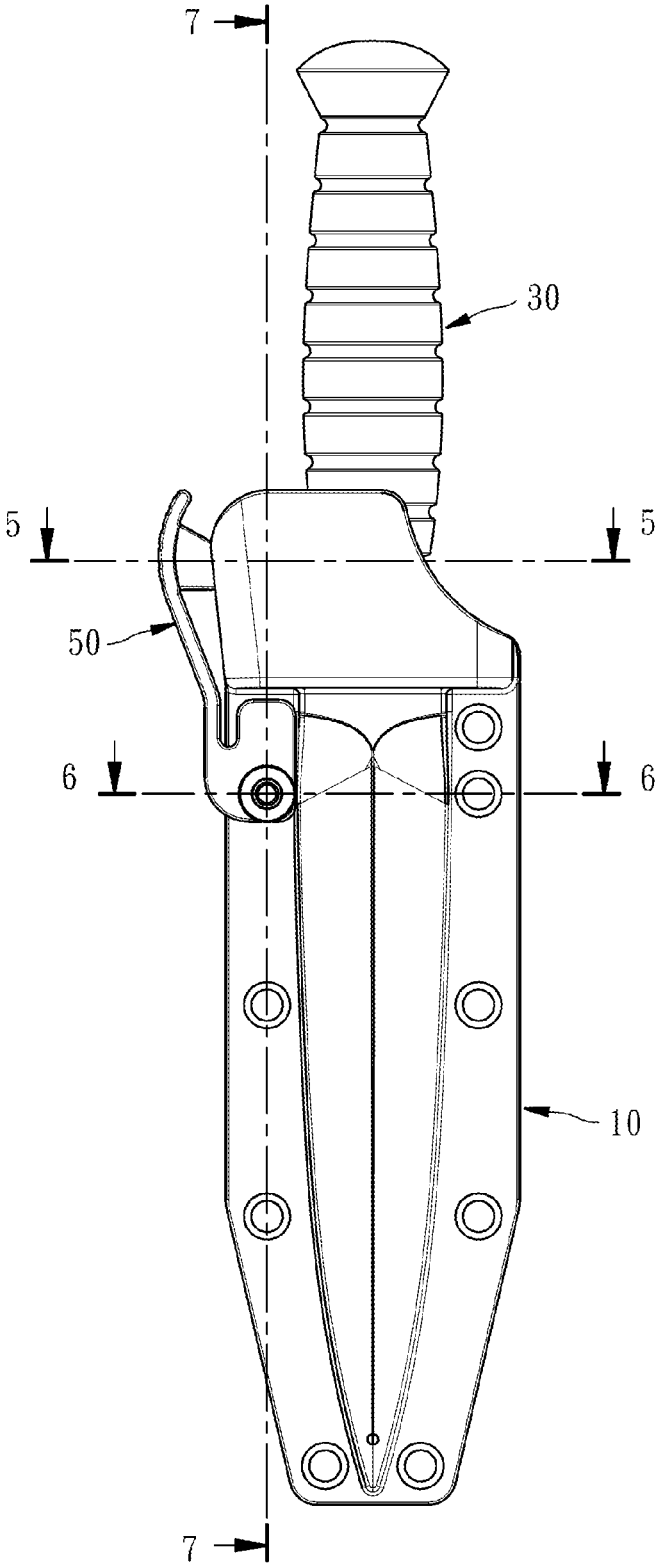
FIG. 4 is a side view of the knife and sheath assembly in accordance with the present invention.

Referring to FIGS. 1-5, a knife and sheath assembly in accordance with the present invention is shown. The knife and sheath assembly comprises a sheath 1, a knife 30, and an operating member 50.

The sheath 1 is formed of two symmetrical sheath halves 10. Each sheath half 10 comprises a knife receptacle 11 defining a knife-receiving open chamber 13 and a plurality of mounting holes 12, a knife stopper 16 connected to the knife receptacle 11, and a stretchable part 18 operable to move the knife stopper 16.

As stated above, the sheath 1 is formed of the aforesaid two symmetrical sheath halves 10, and therefore, the sheath 1 comprises two knife stoppers 16. Further, the stretchable part 18 of each sheath half 10 of the sheath 1 has a beveled or arched surface 19 and form a V-shaped opening therebetween. The sheath 1 further comprises an opening-like sheath collar 15 disposed reversed to the stretchable part 18 of each sheath half 10.

Further, the two sheath halves 10 of the sheath 1 are fastened together with rivets 20. Further, each rivet 20 defines therein an axial center hole 21.

The knife 30 comprises a blade 31 insertable into the knife-receiving open chambers 13 of the two sheath halves 10 of the sheath 1, a handle 33, and shoulder 32 connected between the blade 31 and the handle 33 and stoppable by the knife stoppers 16 of the two sheath halves 10 of the sheath 1.

Each sheath half 10 of the sheath 1 further comprises a bearing surface 17 being biased by the shoulder 32 of the knife 30, the knife stopper 16 of each sheath half 10 is arranged at opposite side of said knife 30.

The operating member 50 comprises a mounting part 51 connected to the sheath 1, an operating part 54, and at least one actuating part 55. The mounting part 51 of the operating member 50 comprises a mounting hole 52 connected to the axial center hole 21 of one rivet 20, and a positioning portion 53 positioned in the axial center hole 21 of another rivet 20. The operating part 54 is operable to force the at least one actuating part 55 against the stretchable part 18 of each sheath half 10 of the sheath 1 in moving the knife stopper 16.

Further, the mounting hole 52 of the mounting part 51 of the operating member 50 is connected to the axial center hole 21 of one rivet 20 in one respective mounting hole 12 of each sheath half 10 of the sheath 1 by a first fastening member (for example, screw nut) 61 and a second fastening member (for example, screw) 62. Further, the actuating part 55 has two beveled or arched surfaces 56 and form a V-shaped wedge.

Figure 5:
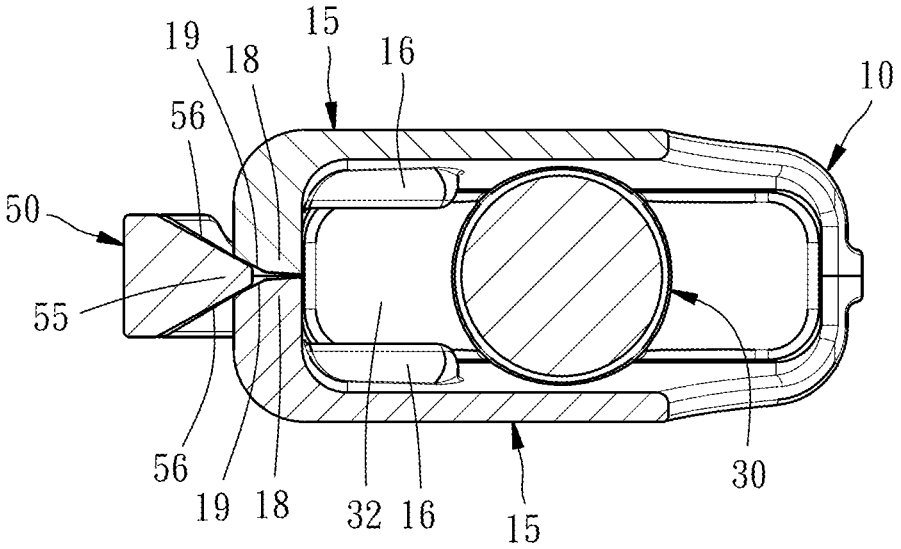
FIG. 5 is a sectional view taken along line 5-5 of FIG. 4.
Figure 6:
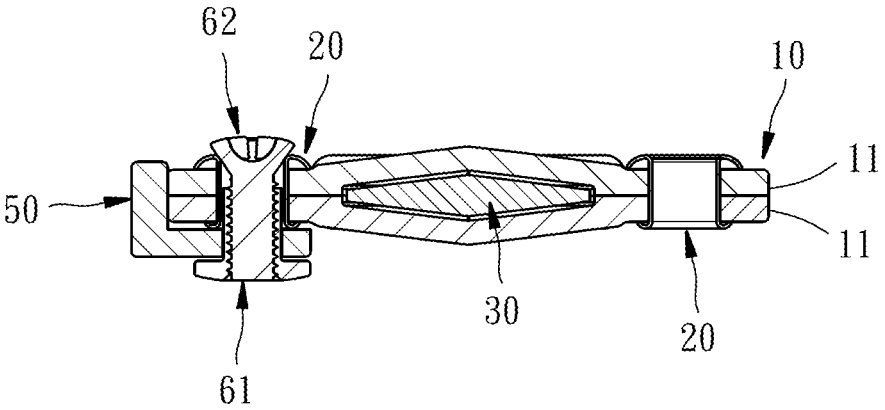
FIG. 6 is a sectional view taken along line 6-6 of FIG. 4.
Figure 7:
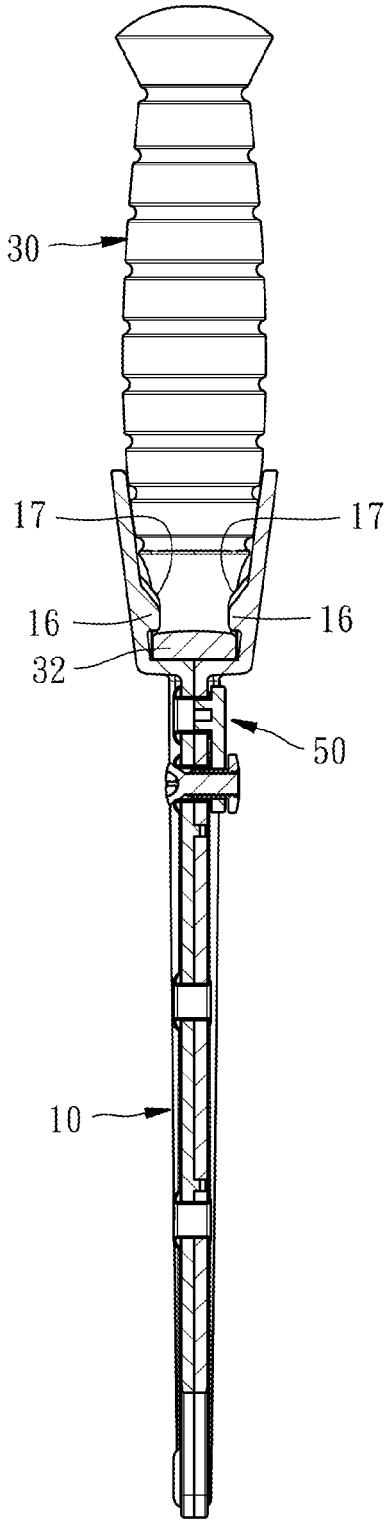
FIG. 7 is a sectional view taken along line 7-7 of FIG. 4.

When the operating part 54 is not pressed, as shown in FIG. 5 and FIG. 7, the knife stopper 16 of each sheath half 10 of the sheath 1 is stopped against the shoulder 32 of the knife 30, prohibiting the knife 30 from being pulled out of the sheath 1.

Figure 8:
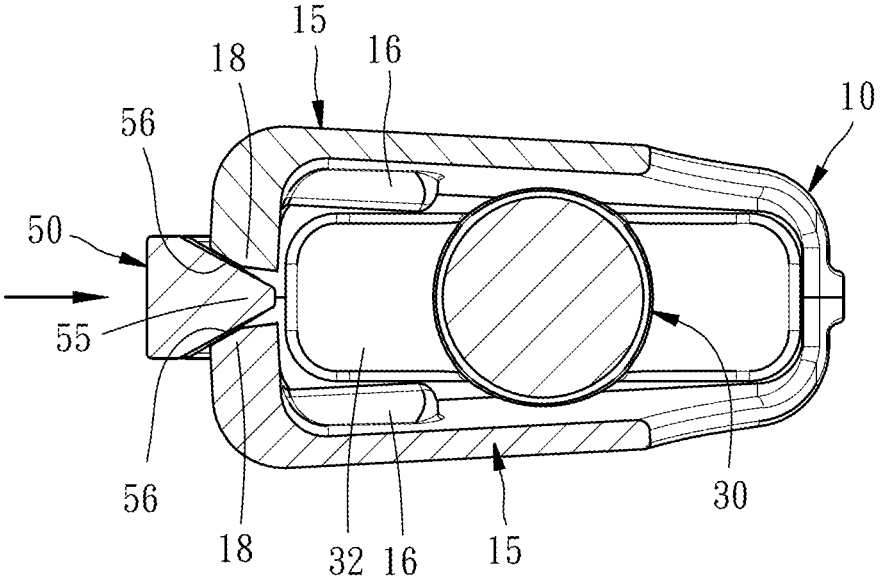
FIG. 8 corresponds to FIG. 4, illustrating the operating part of the operating member pressed.
Figure 9:
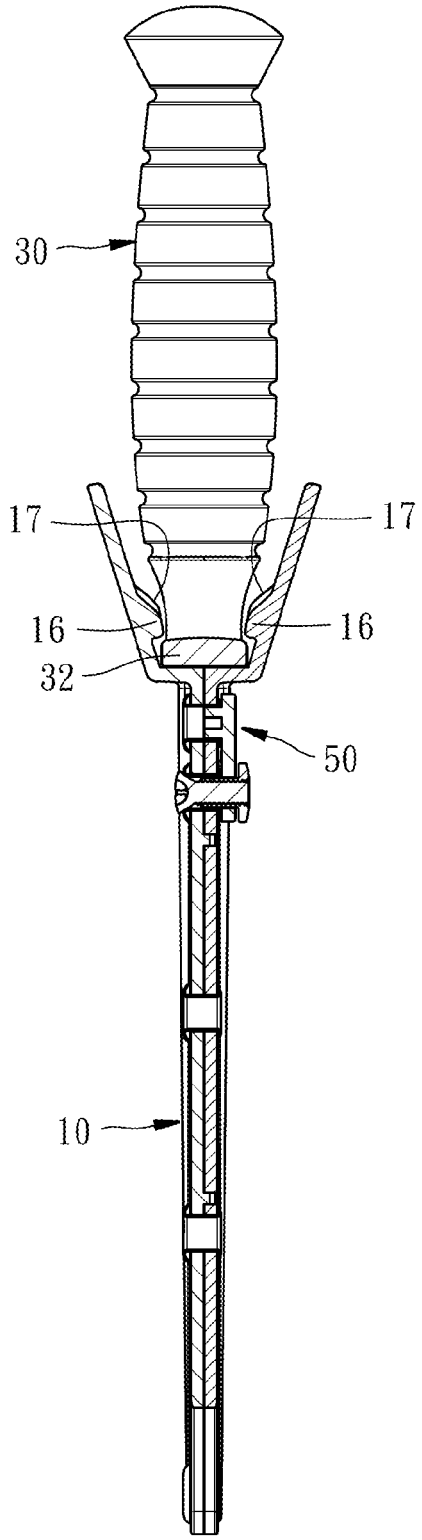
FIG. 9 corresponds to FIG. 5, illustrating the operating part of the operating member pressed.

Referring to FIG. 8 and FIG. 9, when the user presses the operating part 54 of the operating member 50 with the thumb to force the actuating part 55 against the stretchable part 18 of each sheath half 10 of the sheath 1, the sheath collar 15 is elastically expanded, and the knife stopper 16 of each sheath half 10 of the sheath 1 is released from the shoulder 32 for allowing the knife 30 to be taken out of the sheath 1.

Further, the knife and sheath assembly in accordance with the present invention can also be modified in many other ways as follows:

For example, the sheath 1 can be configured to provide only one single knife stopper 16 at one lateral side.

Alternatively, the sheath 1 can be configured to provide only one single stretchable part 18 at one lateral side, and the actuating part 55 of the operating member 50 can also be configured to provide only one beveled surface or arched surface 56.

Alternatively, the operating member 50 can be configured to provide two opposing actuating parts 55.

Alternatively, the operating member 50 can be mounted in the knife 30 instead of mounting the operating member 50 in the sheath 1, for example, the mounting part 51 of the operating member 50 can be affixed to the knife 30.

Further, the stretchable part 18 of the sheath 1 can be a beveled or arched surface.

In conclusion, the invention provides a knife and sheath assembly knife and sheath assembly with releasable knife securing function, which normally keeps the knife 30 locked in the sheath 1, and which is equipped with an operating member 50 that is conveniently pressable by the user to release the knife 30 from the locking position for allowing removal of the knife 30 from the sheath 1.

What is claimed is:

1. A knife and sheath assembly, comprising:

a sheath (1) comprising a knife receptacle (11) defining therein a knife-receiving open chamber (13), at least one knife stopper (16) located at said knife receptacle (11), and a stretchable part (18) operable to move said knife stopper (16);

a knife (30) comprising a blade (31) insertable into said knife-receiving open chamber (13) of said sheath (1), a handle (33), and a shoulder (32) connected between said blade (31) and said handle (33) and stoppable by said at least one knife stopper (16) of said sheath (1) to keep said blade (31) in said knife-receiving open chamber (13); and an operating member (50) comprising a mounting part (51) affixed to said sheath (1), and at least one actuating part (55) connected to said mounting part (51), the at least one actuating part (55) operable to be forced against said stretchable part (18) of said sheath (1) to cause said at least one knife stopper (16) to move in a direction away from said shoulder (32) of said knife (30), wherein said sheath (1) is formed of two sheath halves (10), said two sheath halves (10) of said sheath (1) are fastened together with rivets (20), wherein at least one of said rivets (20) defines therein an axial center hole (21), and wherein said operating member (50) is connected to the axial center hole (21) of one said rivet (20).

2. The knife and sheath assembly as claimed in claim 1, wherein the number of said at least one knife stopper (16) is two and arranged at opposite side of said knife (30).

3. The knife and sheath assembly as claimed in claim 1, wherein said stretchable part (18) of said sheath (1) is made in one of the forms of beveled surface and arched surface (19).

4. The knife and sheath assembly as claimed in claim 1, wherein the number of said stretchable part (18) of said sheath (1) is two, said two stretchable parts (18) formed a V-shaped opening, said actuating part (55) of said operating member (50) formed a V-shaped wedge.

5. The knife and sheath assembly as claimed in claim 1, wherein each of said at least one actuating part (55) of said operating member (50) is made in one of the forms of beveled surface and arched surface (56).

6. The knife and sheath assembly as claimed in claim 1, wherein said operating member (50) further comprises a positioning portion (53) positioned in the axial center hole (21) of one said rivet (20).

7. The knife and sheath assembly as claimed in claim 1, wherein said sheath (1) further comprises a bearing surface (17) being biased by said shoulder (32) of said knife (30).

8. The knife and sheath assembly as claimed in claim 1, wherein said sheath (1) comprises at least one mounting hole (12); said operating member (50) is fastened to at least one said mounting hole (12) of said sheath (1).

9. A knife and sheath assembly, comprising:

a sheath (1) comprising a knife receptacle (11) defining therein a knife-receiving open chamber (13), at least one knife stopper (16) located at said knife receptacle (11), and a stretchable part (18) operable to move said knife stopper (16);

a knife (30) comprising a blade (31) insertable into said knife-receiving open chamber (13) of said sheath (1), a handle (33), and a shoulder (32) connected between said blade (31) and said handle (33) and stoppable by said at least one knife stopper (16) of said sheath (1) to keep said blade (31) in said knife-receiving open chamber (13); and an operating member (50) comprising a mounting part (51) affixed to said sheath (1), and at least one actuating part (55) connected to said mounting part (51), the at least one actuating part (55) operable to be forced against said stretchable part (18) of said sheath (1) to cause said at least one knife stopper (16) to move in a direction away from said shoulder (32) of said knife (30), wherein said operating member (50) comprises a mounting hole (52) fastened to said sheath (1).

10. A knife and sheath assembly, comprising:

a sheath (1) comprising a knife receptacle (11) defining therein a knife-receiving open chamber (13), at least one knife stopper (16) located at said knife receptacle (11), and a stretchable part (18) operable to move said knife stopper (16);

a knife (30) comprising a blade (31) insertable into said knife-receiving open chamber (13) of said sheath (1), a handle (33), and a shoulder (32) connected between said blade (31) and said handle (33) and stoppable by said at least one knife stopper (16) of said sheath (1) to keep said blade (31) in said knife-receiving open chamber (13); and an operating member (50) comprising a mounting part (51) affixed to said sheath (1), and at least one actuating part (55) connected to said mounting part (51), the at least one actuating part (55) operable to be forced against said stretchable part (18) of said sheath (1) to cause said at least one knife stopper (16) to move in a direction away from said shoulder (32) of said knife (30), wherein said operating member (50) is affixed to said sheath (10) by a female type first fastening member (61) and a male type second fastening member (62).

* * * * *